US008113175B2

(12) United States Patent
Williams

(10) Patent No.: US 8,113,175 B2
(45) Date of Patent: Feb. 14, 2012

(54) FUEL INJECTION SYSTEM

(75) Inventor: Anthony John Williams, Middlesex (GB)

(73) Assignee: Delphi Technologies Holding S.arl, Troy, MI (US)

( * ) Notice: Subject to any disclaimer, the term of this patent is extended or adjusted under 35 U.S.C. 154(b) by 229 days.

(21) Appl. No.: 12/374,534

(22) PCT Filed: Jul. 20, 2007

(86) PCT No.: PCT/GB2007/002795

§ 371 (c)(1),
(2), (4) Date: Oct. 6, 2009

(87) PCT Pub. No.: WO2008/009974

PCT Pub. Date: Jan. 24, 2008

(65) Prior Publication Data

US 2010/0050989 A1 Mar. 4, 2010

(30) Foreign Application Priority Data

Jul. 21, 2006 (GB) ..... 0614537.9
Jul. 20, 2007 (WO) ..... PCT/GB2007/002795

(51) Int. Cl.
*F02M 69/54* (2006.01)
*F02M 51/00* (2006.01)

(52) U.S. Cl. ..... 123/447; 123/457; 123/472; 123/511

(58) Field of Classification Search ..... 123/447, 123/457, 472, 495, 510, 511
See application file for complete search history.

(56) References Cited

U.S. PATENT DOCUMENTS

| | | | | |
|---|---|---|---|---|
| 6,637,408 | B2 * | 10/2003 | Djordjevic | 123/456 |
| 6,843,053 | B2 * | 1/2005 | Draper et al. | 60/274 |
| 7,047,941 | B2 * | 5/2006 | Draper et al. | 123/447 |
| 7,143,746 | B2 * | 12/2006 | Knight et al. | 123/447 |
| 7,252,070 | B2 * | 8/2007 | Magel | 123/446 |
| 7,418,941 | B2 * | 9/2008 | Music et al. | 123/299 |

FOREIGN PATENT DOCUMENTS

| | | | |
|---|---|---|---|
| EP | 1 273 797 | * | 5/2002 |
| JP | 9-177586 | | 7/1997 |
| WO | 2005/124145 | | 12/2005 |

OTHER PUBLICATIONS

WO 2005/124145, Magel, Dec. 29, 2005.*
Japan Office Action dated Jul. 8, 2011.

* cited by examiner

*Primary Examiner* — Hai Huynh
(74) *Attorney, Agent, or Firm* — Thomas N. Twomey

(57) ABSTRACT

A fuel injection system for an internal combustion engine comprises: a first fuel injector which is arranged within a housing unit; an accumulator volume for supplying fuel to the first fuel injector; a first fuel pump arrangement comprising a pumping plunger which is driven, in use, to cause pressurisation of fuel within a first pump chamber; a first metering valve which is operable to control fuel flow into the first pump chamber; a first fuel passage providing communication between the first pump chamber and the accumulator volume; and a first non-return valve located in the first fuel passage between the first pump chamber and the accumulator volume; wherein the first fuel injector communicates with the first fuel passage at a position between the first non-return valve and the accumulator volume; and wherein communication between the first fuel injector and the accumulator volume is uninterrupted.

13 Claims, 7 Drawing Sheets

FUEL INJECTION SYSTEM

TECHNICAL FIELD

The present invention relates to a fuel injection system for an internal combustion engine. In particular, the invention relates to a fuel injection system including an accumulator volume in the form of a common rail.

BACKGROUND OF THE INVENTION

In known fuel injector designs, a nozzle control valve is provided to control movement of a fuel injector valve needle relative to a seating and, thus, the delivery of fuel from the injector. A so-called Electronic Unit Injector (EUI) is an example of such an injector. An EUI includes a dedicated pump having a cam-driven plunger for raising fuel pressure within a pump chamber, and an injection nozzle through which fuel is injected into an associated engine cylinder. A metering valve is operable to control the pressure of the fuel within the pump chamber. When the metering valve is in an open position, the pump chamber communicates with a low pressure fuel reservoir so that fuel pressure within the pump chamber is not substantially affected by movement of the plunger and fuel is simply drawn into and displaced from the pump chamber as the plunger reciprocates. Closure of the metering valve causes pressure in the pump chamber to rise as the plunger is driven to reduce the volume of the pump chamber. Each EUI also has an electronically controlled nozzle control valve that is arranged to control the timing of commencement and termination of the injection of fuel into an associated engine cylinder. Typically, the engine is provided with a plurality of EUIs, one for each cylinder of the engine.

Although the use of a nozzle control valve in an EUI provides a capability for controlling the injection timing, and such units are capable of achieving high injection pressures, both injection pressure and injection timing are limited to some extent by the nature of the associated cam drive.

In common rail fuel injection systems, a single pump is arranged to charge an accumulator volume, or common rail, with high pressure fuel for supply to a plurality of injectors of the fuel system. As in an EUI, the timing of injection is controlled by means of a nozzle control valve associated with each injector. One advantage of the common rail system is that the timing of injection of fuel at high pressure is not dependent upon a cam drive, and so the flexibility of injection timing is good. However, achieving very high injection pressure within a common rail system is problematic and requires a dedicated high pressure pump of significant cost.

Recognising that both EUI and common rail systems have certain disadvantages, in granted U.S. Pat. No. 7,047,941 (Delphi Technologies Inc.) the Applicants have previously proposed a hybrid fuel injection system which combines the functionality and benefits of both types of system, whilst avoiding several of the drawbacks of each of them.

FIG. 1 shows a hybrid system of the aforementioned type including a common rail fuel pump 10 which supplies fuel at a moderately high and injectable pressure level (e.g. 300 bar) to a common rail 12. This is referred to as the first pressure level. The common rail 12 supplies pressurised fuel to a first supply passage 14 which communicates with a pump chamber 16 under the control of a rail control valve 18. The pump chamber 16 forms part of a pump arrangement including a pumping plunger 20 that is driven by means of a driven cam 22, typically a roller and rocker mechanism. The pump chamber 16 supplies fuel to a dedicated fuel injector 24 which is separated from the pump chamber 16 by a second supply passage 26. The fuel injector 24 is arranged to inject fuel into the engine when a valve needle 28 of the injector is caused to lift under the control of an injector control valve 30.

The fuel injection system of FIG. 1 has two key modes of operation. If the rail control valve 18 is closed, movement of the plunger 20 under the influence of the cam 22 causes fuel within the pump chamber 16, which is initially at a relatively low level, to be increased to a variable, higher pressure level. Fuel at this second, variable higher pressure level is then delivered through the second supply passage 26 to the injector 24 and is delivered to the engine under the control of the injector control valve 30. If, however, the rail control valve 18 is open, the action of the plunger 20 has no pressurizing effect on fuel within the pump chamber 16 and so fuel is delivered to the injector 24 at the first pressure level. By controlling the status of the rail control valve 18 it is therefore possible to vary the injection pressure between the first and second pressure levels.

Whilst the hybrid system in FIG. 1 provides many advantages over the more conventional systems, it is not compatible with many existing engine installations. Where manufacturers have invested heavily in production line facilities for one type of engine installation, the cost of re-tooling can be prohibitive to manufacturing different types of engine.

It is with a view to addressing this problem in particular that the invention provides an improved fuel injection system which is compatible with many existing assembly line facilities.

SUMMARY OF THE INVENTION

According to the present invention there is provided a fuel injection system comprising a fuel injector which is arranged within a housing unit; an accumulator volume for supplying fuel to the fuel injector; and a fuel pump arrangement comprising a pumping plunger which is movable within the housing unit to cause pressurisation of fuel within a pump chamber. A metering (or spill) valve is operable to control fuel flow into and out of the pump chamber. A fuel passage provides communication between the pump chamber and the accumulator volume. A non-return valve is located in the fuel passage between the pump chamber and the accumulator volume and the injector communicates with the fuel passage downstream of the non-return valve. The communication between the first fuel injector and the accumulator volume is uninterrupted.

By "uninterrupted" in the sense of an uninterrupted communication, it is meant that the fluid flow path between the accumulator volume and the fuel injector is free from physical barriers to the movement of fuel. In particular, the passage (or passages) that connect(s) the fuel injector to the accumulator volume does not contain any hydraulic devices, such as valves, membranes or pistons, which may act to control (or prevent) the movement of fuel from the accumulator volume to the fuel injector. In this way, the fuel injector is not prevented or substantially hindered from receiving a substantial flow of fuel, suitable for a main injection event, directly from the accumulator volume.

The invention provides the advantage that it is compatible with existing engine installations designed for EUIs as the injector and the pumping plunger are both accommodated within the same housing unit, together with the fuel passage between them. It is therefore possible for engine manufacturers to use existing production line facilities designed for engines with EUI systems without the need to re-tool, whilst at the same time providing an engine to the end user which has the benefits of a common rail system also. For example, injection timing is not dependent on the nature of the cam drive, but can be independent of this due to the presence of the common rail accumulator volume. The timing of injection is therefore much more flexible.

It is a further advantage of the invention that as the injector component of the system is in close proximity to the pumping element of the system (i.e. the two are located within the same housing, or are located in immediately adjacent housing parts forming a common housing unit), pressure wave effects, which can otherwise adversely affect performance, are minimised.

Moreover, the system does not require a separate and dedicated high pressure pump to supply pressurised fuel to the common rail as the pumping arrangement of the system provides this function itself.

It is a further advantage over known hybrid common rail-EUI systems that the pumping chamber and the metering valve are isolated from the high pressure fuel source (the common rail) for most of the pumping stroke, and so high pressure fuel leakage (e.g. through the plunger bore and the metering valve) is reduced.

In one embodiment, in use, the fuel injector receives fuel primarily from the accumulator volume and not from the pump chamber. Thus, during a fuel injection event the non-return valve is typically closed, essentially isolating the accumulator volume and fuel injector on one side from the pump chamber on the other. Thus, a further advantage of the invention is that the fuel injection system may suitably comprise more than one injector for each fuel pump; each of the fuel injectors receiving fuel from a high pressure reservoir (or accumulator volume), rather than from a dedicated fuel pump.

The injector is preferably an electronically controlled injector and may include a three way control valve for controlling movement of an injector valve needle so as to control fuel injection into the engine. In other versions of the system the injector includes a two way control valve.

In a further preferred embodiment, the fuel injection system includes at least one restriction between the non-return valve and the accumulator volume. This provides a degree of variation of the injector pressure with engine speed. By way of example, the restriction may be located approximately at the outlet of the accumulator volume.

By way of further example, the system may comprise a supply passage to the injector for receiving fuel from the fuel passage and through which fuel is delivered to the injector, wherein the restriction is located immediately upstream of an interconnection between the supply passage and the fuel passage.

In one mode of operation, a control method for a fuel injection system of the invention includes driving the pumping plunger by means of a cam having a cam profile with a rising flank and a falling flank, wherein the rising flank corresponds to a pumping stroke of the plunger pumping cycle during which the pumping plunger is driven to reduce the volume of the pump chamber and the falling flank corresponds to a return stroke of the plunger pumping cycle during which the pumping plunger is retracted from the pump chamber to increase the volume of the pump chamber, operating the metering valve so that it is open during at least a portion of the return stroke so as to allow fuel to flow into the pump chamber for pressurisation and operating the metering valve so that it is closed during at least a portion of the pumping stroke so as to cause pressurisation of fuel within the pump chamber. The metering valve may, advantageously, be held closed at the end of the pumping stroke until the plunger has ridden over the cam nose. This mode of operation provides an advantage in terms of energy conservation and also in terms of audible noise level.

In another mode of operation, the control method includes operating the metering valve so that it is closed during at least a portion of the pumping stroke so as to cause pressurisation of fuel within the pump chamber, and re-opening the metering valve at the end of the pumping stroke prior to the plunger riding over the cam nose. It has been found that this mode of operation provides a benefit as it reduces Hertz stresses on some cam profiles.

The background to the invention has already been described, by way of example only, with reference to FIG. 1 which shows a schematic diagram of a known fuel injection system having a common rail, which is supplied with fuel from a high pressure pump, in combination with an additional pumping element.

BRIEF DESCRIPTION OF THE DRAWINGS

The present invention will now be described, by way of example only, with reference to the following figures in which.

DESCRIPTION OF THE PREFERRED EMBODIMENT

Figure 2:
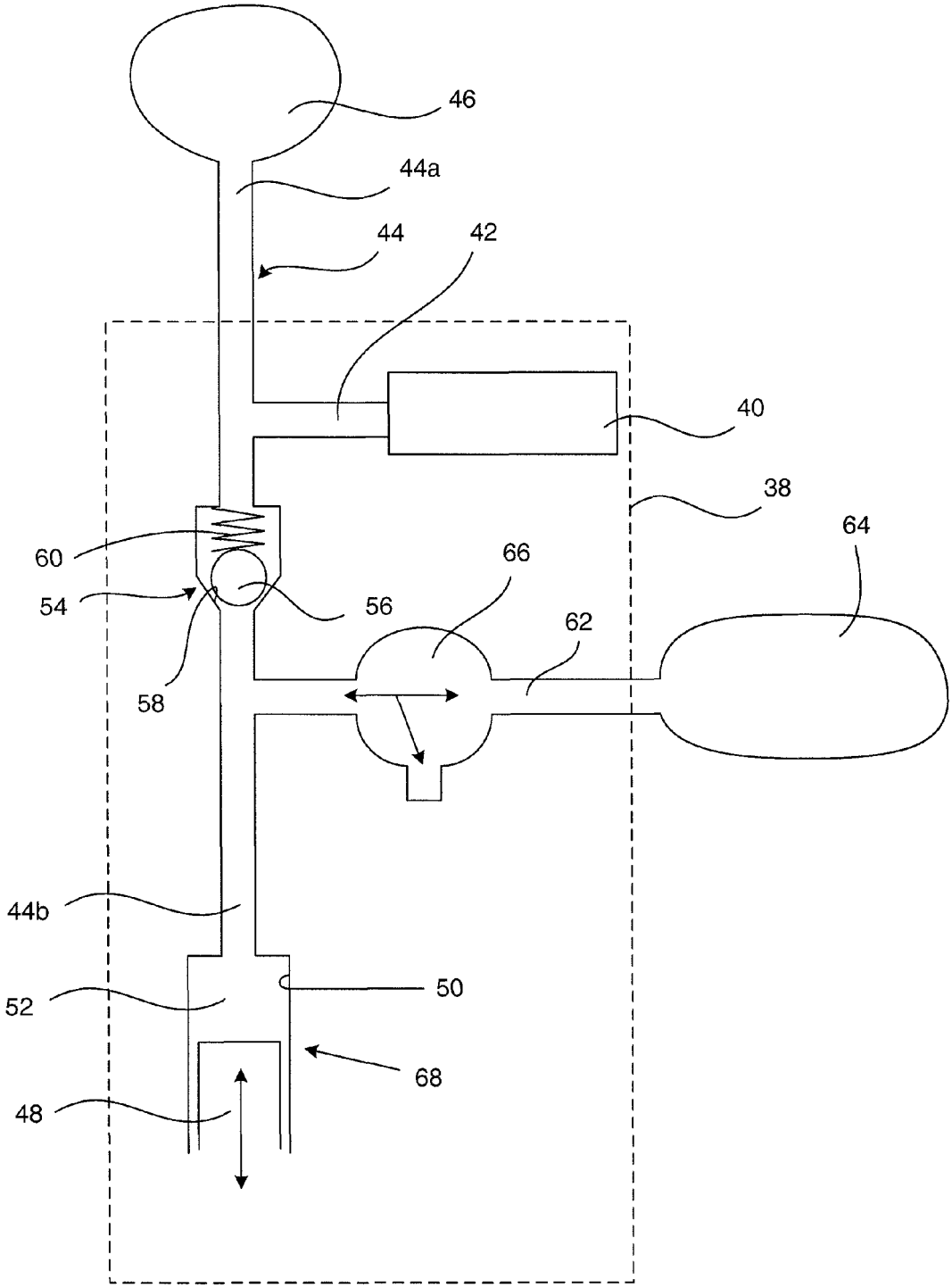
FIG. 2 which shows a schematic diagram of one cylinder of a fuel injection system of a first embodiment of the invention.

The fuel injection system in FIG. 2 includes an injector 40 which is supplied with fuel via an injector inlet passage 42. The injector inlet passage 42 receives fuel from a fuel passage 44 which communicates, at one end 44*a*, with an accumulator volume in the form of a common rail 46. As would be understood by a person skilled in the art, the phrase common rail is not intended to be limiting and is used to describe any volume for storing fuel, whether it is elongate (i.e. a length of pipe), cylindrical, spherical or any other shape.

The injector 40 is arranged within (or at least in part defined by) an injector housing unit 38, indicated generally by the dashed line. The injector 40 is not shown in detail, but typically includes an injector valve needle (not shown) which is movable towards and away from an injector valve seat to control the delivery of fuel from the injector 40 into the associated engine cylinder. To control opening and closing of the injector valve needle, an injector control valve (also not shown) is provided which controls the pressure of fuel supplied to the back of the valve needle (i.e. the end remote from the injector valve seat). The injector control valve may be a two-way valve or a three-way valve, the design and operation of which would be familiar to a person skilled in the art. A description of an injector having a three-way injector control valve can be found, for example, in EP 1359316 (Delphi Technologies Inc.).

The fuel injection system further includes a pump arrangement 68 which is arranged within the injector housing 38, together with the injector 40. The pump arrangement 68 includes a pumping plunger 48 which is movable within a bore 50 provided in the injector housing 38 so as to cause, in certain circumstances, pressurisation of fuel within a pump chamber 52 formed at one end of the bore 50. The pumping plunger 48 is driven by means of a drive arrangement (not shown) which includes an engine driven cam having one or more cam lobes. The pumping plunger 48 is typically driven by the cam via a roller and rocker mechanism (not shown) in a known manner. Alternatively, the pumping plunger may be driven by the cam via a guided tappet.

The pump chamber 52 communicates with a second end 44*b* of the fuel passage 44 remote from the common rail 46. A non-return valve 54 is located within the fuel passage 44 so that the common rail 46 communicates with the pump chamber 52 via the non-return valve 54. The non-return valve 54 includes a ball 56 which is biased against a valve seat 58 by means of a spring 60. The biasing force of the spring 60 sets an opening pressure for the valve at which the ball 56 is caused to lift from its seat 58 to allow the pump chamber 52 to communicate with the common rail 46, and ensures the valve remains on its seat when there is no pressure in the system.

A pump supply passage 62 branches from the fuel passage 44, on the pump chamber side of the non-return valve 54, and allows fuel from a low pressure fuel reservoir 64, located external to the injector housing 38, to flow into the pump chamber 52. In contrast, the injector supply passage 42 branches from the fuel passage 44 on the common rail side of the non-return valve 54 (i.e. on the other side of the non-return valve 54 to the pump supply passage 62). The pump supply passage 62 is provided with an electronically controlled valve 66, also referred to as a "metering valve" (or sometimes a "spill valve"), which is operable between an open state, in which fuel is able to flow into the pump chamber 52 from the low pressure fuel reservoir 64, and a closed state in which communication between the low pressure fuel reservoir 64 and the pump chamber 52 is broken.

Figure 3:
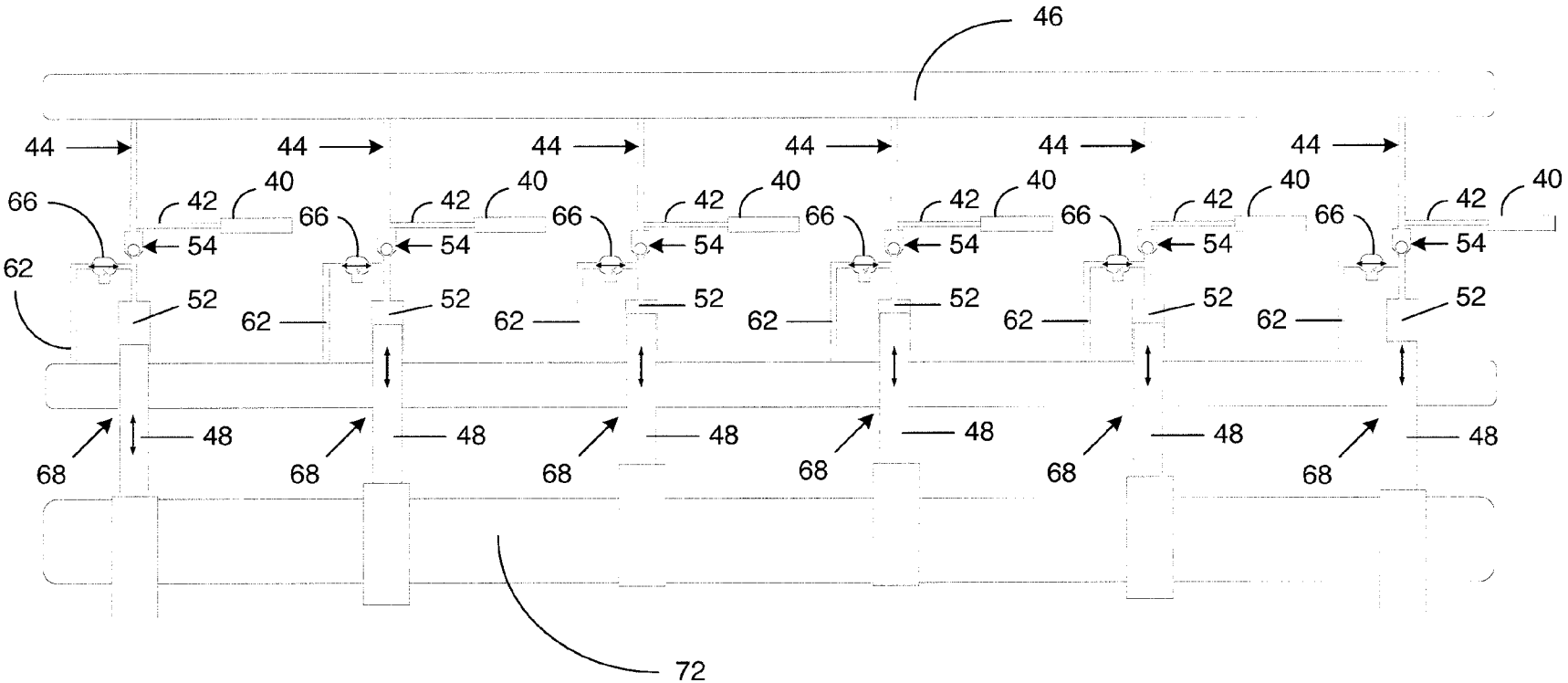
FIG. 3 shows a schematic diagram of a fuel injection system of a second embodiment of the invention comprising a plurality of fuel injectors and pump arrangements.

As the injector 40 and the pump arrangement form part of a shared housing unit 38, they can be positioned in an engine in the same way as a conventional EUI with the tip of the injector 40 (referred to as the nozzle) protruding into the associated engine cylinder in a conventional way. In practice, in this embodiment the fuel injection system may include a plurality of fuel injectors, each of which may be provided with its own dedicated pump arrangement 68 in a shared housing, as illustrated in FIG. 3 in which like reference numerals are used to denote similar parts. Advantageously, the system is provided with only one common rail 46 so that the common rail delivers fuel to each of the injectors 40 of the engine via respective supply passages (such as passage 44).

Operation of the fuel injection systems of FIGS. 2 and 3 will now be described in further detail.

In use, the pumping plunger 48 is driven by the main engine camshaft 72 to perform a pumping cycle consisting of a return stroke, in which the pumping plunger 48 is withdrawn from the bore 50 to expand the volume of the pump chamber 52, and a pumping stroke, in which the pumping plunger 48 is driven into the bore 50 so as to reduce the volume of the pump chamber 52. At the start of the plunger return stroke (i.e. just after the end of the pumping stroke), the pumping plunger 48 is said to be at the top of its stroke and the pump chamber volume is a minimum, and at the end of its return stroke (i.e. just before the start of the pumping stroke) the pumping plunger 48 is said to be at the bottom of its stroke and the pump chamber volume is a maximum.

In a first mode of operation, initially the metering valve 66 is open so that as the pumping plunger 48 performs its return stroke fuel is drawn through the pump supply passage 62, through the open metering valve 66 and into the pump chamber 52. Once the pumping plunger 48 has completed its return stroke, so that the pump chamber 52 is filled with low pressure fuel, it commences its pumping stroke. At an appropriate point in the pumping stroke, the metering valve 66 is closed to prevent further communication between the low pressure fuel reservoir 64 and the pump chamber 52. By holding the metering valve 66 open for an initial period of the plunger pumping stroke, a proportion of fuel that is drawn into the pump chamber 52 during the return stroke is dispelled through the open metering valve 66, back to the low pressure reservoir 64, before pressurisation within the pump chamber 52 commences. Continued motion of the pumping plunger 48 through its pumping stroke results in fuel within the pump chamber 52 being pressurised to a high level.

Once fuel pressure in the pump chamber 52 exceeds that within the common rail 46, the non-return valve 54 is caused to open, against the spring force, to allow pressurised fuel in the pump chamber 52 to flow to the common rail 46. The flow of fuel continues until the pump chamber 52 is at its minimum volume, i.e. when the pumping plunger 48 is at the top of its stroke. The pumping plunger 48 rides over the nose of the cam to start its return stroke, and the pressure in the pump chamber 52 gradually starts to reduce. Eventually, part way through the return stroke, the pressure in the common rail 46 will exceed that in the pump chamber 52 and the non-return valve 54 will be caused to close under the force of the biasing spring 60 so that communication between the pump chamber 52 and the common rail 46 is broken. High pressure fuel then remains trapped in the common rail 46.

Once fuel pressure in the pump chamber 52 has reduced to a low level and the non-return valve 54 has closed to trap high pressure fuel in the common rail 46, the metering valve 66 is opened once more to allow communication between the low pressure fuel reservoir 64 and the pump chamber 52 and, hence, the next filling cycle commences. The metering valve 66 is suitably opened just after the pumping plunger 48 has started its return stroke. By operating in this mode it has been found to provide a benefit in terms of energy conservation and audible noise levels.

With the common rail 46 charged with high pressure fuel, the injector 40 can then be operated so as to inject fuel into the engine cylinder. Injection is initiated by operating the injector control valve so as to cause the valve needle of the injector to lift away from the injector valve seat. Fuel in the common rail 46 is delivered through the fuel passage 44 to the injector inlet passage 42, and hence to the injector, but is unable to return to the pump chamber 52 due to the closed non-return valve 54.

In a second mode of operation, rather than holding the metering valve 66 closed as the plunger rides over the cam nose, the metering valve 66 may be re-opened at the end of the pumping stroke so as to reduce Hertz stresses on the cam. In this mode of operation, the metering valve 66 may be closed relatively early in the pumping stroke, just after bottom-dead-centre and earlier on the accelerating part of the cam.

In a third mode of operation, the metering valve 66 may be closed part way through the return stroke of the pumping plunger 48 so as to control the quantity of fuel that is actually drawn into the pump chamber 52 (i.e. part-filling of the pump chamber 52) for pressurisation. In this mode of operation the metering valve therefore provides an inlet metering function.

Figure 4:
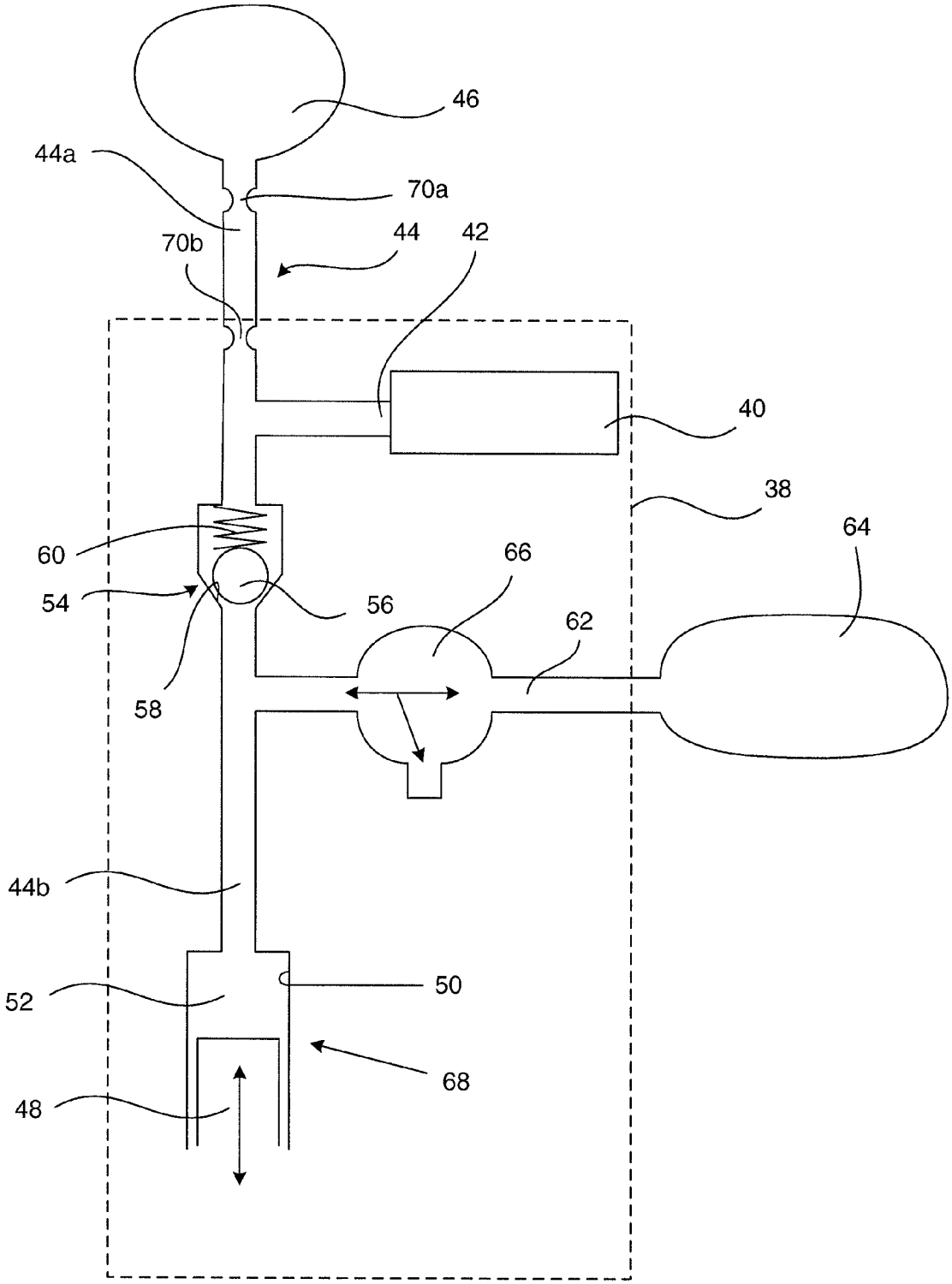
FIG. 4 is a schematic diagram of a fuel injection system of a third embodiment of the invention comprising a single injector and a single pump arrangement.

A third embodiment of the invention is shown in FIG. 4, in which like reference numerals are used to denote similar parts. Here, the fuel passage 44 between the non-return valve 54 and the common rail 46 is provided with first and second orifices or restrictions 70*a*, 70*b*. The first orifice 70*a* is located at the outlet of the common rail 46 and the second orifice 70*b* is located just upstream of the point at which the fuel passage 44 feeds the injector inlet passage 42. The presence of the orifices 70*a*, 70*b* has two effects. Firstly, pressure wave effects arising within the fuel passage 44 as a result of the pumping action of the pumping plunger 48 are damped. Secondly, the orifices 70*a*, 70*b* provide a tuning mechanism to facilitate variation in injection pressure due to the variable pressure drop across the orifices 70*a*, 70*b* with engine speed (i.e. plunger speed).

A further advantage of providing an orifice in the fuel passage 44, between the point of interconnection between the fuel passage 44 and the injector inlet passage 42 and the common rail 46, is that for particularly high engine speeds (i.e. higher plunger speeds) the pressure supplied to the injector through the inlet passage 42 will be higher than fuel pressure within the common rail 46. It is possible to locate both the pumping element of the system (i.e. the plunger 48) and the injector 40 upstream of the orifices 70*a*, 70*b* as the plunger 48 and the injector 40 are housed within a common housing.

In practice only one orifice may be provided, either at the location of orifice 70*a* or that of orifice 70*b*, or two orifices may be provided as discussed above. It will be appreciated that where a fuel injection system of the invention comprises more than one fuel injector and fuel pump (as depicted in FIG. 3), either or both of the orifices 70*a* and 70*b* may be employed in one or more, and suitably each, of the fuel supply passages 44.

Figure 5:
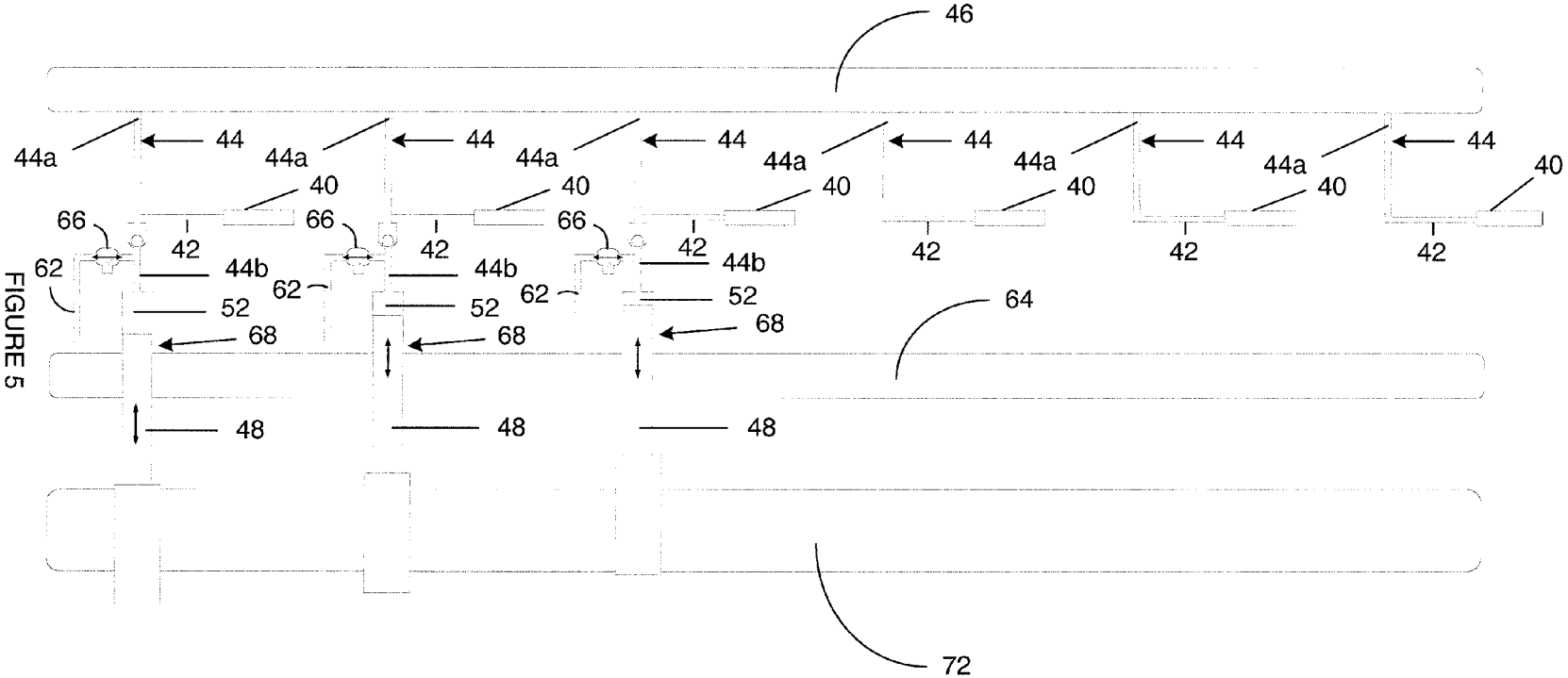
FIG. 5 is a schematic diagram of a fuel injection system of a fourth embodiment of the invention comprising a plurality of fuel injectors and pump arrangements.

A further modification to the embodiments of the invention previously described is illustrated by way of non-limiting example in FIG. 5, in which the fuel injection system comprises a plurality of fuel injectors.

In this embodiment the fuel injection system includes a plurality of (six) fuel injectors 40 which are supplied with fuel via respective injector inlet passages 42. The injector inlet passages 42 receive fuel from fuel passages 44 (as before) which communicate, at one end 44*a*, with a single accumulator volume in the form of a common rail 46.

The fuel injection system further includes three pump arrangements 68 (as previously described), which are arranged to supply pressurised fuel via the respective fuel passages 44 to the common rail 46. As before, the pumping plunger 48 of each pump arrangement 68 is driven by means of a drive arrangement (not shown), which includes an engine driven cam having one or more cam lobes and a main engine camshaft 72. The pumping plunger 48 is typically driven by the cam via a roller and rocker mechanism (not shown) in a known manner. Alternatively, the pumping plunger may be driven by the cam via a guided tappet. Each pump chamber 52 of the pump arrangements 68 communicates with a second end 44*b* of its respective fuel passage 44 remote from the common rail 46.

A non-return valve 54 is located within each fuel passage 44 that connects the common rail 46 to a pump chamber 52 of a pump arrangement 68. In this way, the common rail 46 can only communicate with the pump chambers 52 via the non-return valves 54. The non-return valves 54 are arranged to ensure that the valves are closed when there is no pressure in the system, and when the fuel pressure in the respective fuel passages 44 exceeds that of the respective pump chambers 52. In one mode of operation, the non-return valves 54 also remain closed during fuel injection events, such that fuel to the injectors 40 is supplied from the common rail 46 and not from the pump chambers 52 of the fuel pumps. In this way, the fuel injection system provides the advantage that injection events may be completely independent of the fuel pump and cam rotation cycle, as described elsewhere herein.

For each fuel passage 44 that communicates with a fuel pump, a pump supply passage 62 branches from that fuel passage 44, on the pump chamber side of the non-return valve 54, and allows fuel from a low pressure fuel reservoir 64 to flow into the pump chamber 52. The pump supply passage 62 is again provided with an electronically controlled valve 66, in the form of a "metering valve" (but it may also be a "spill valve"), which is operable between an open state, in which fuel is able to flow into the pump chamber 52 from the low pressure fuel reservoir 64, and a closed state in which communication between the low pressure fuel reservoir 64 and the pump chamber 52 is broken.

For each of the fuel passages 44 that also communicates with a fuel pump, the injector supply passage 42 branches from the fuel passage 44 on the common rail side of the non-return valve 54 (i.e. on the other side of the non-return valve 54 to the pump supply passage 62). In contrast, for the fuel passages 44 that are not in communication with a pump chamber 52 of a pump arrangement 68, the fuel passage 44 communicates at the end 44*a* with the common rail 46 (as previously described), and at the other end with an injector supply passage 42 and an injector 40.

Figure 6:
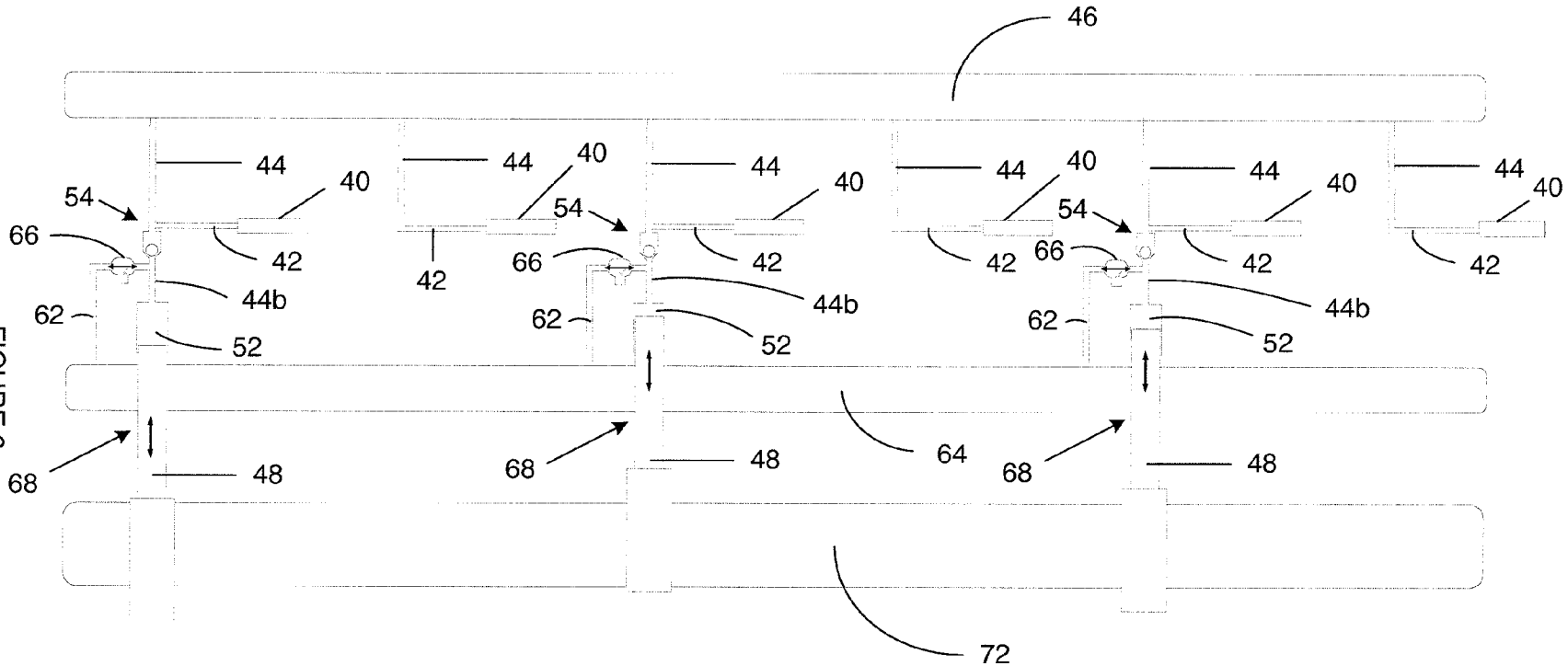
FIG. 6 shows an alternative configuration of the fuel injection system of the fourth embodiment of the invention.

FIG. 6 shows an alternative configuration of the fuel injection system of FIG. 5. Again, three fuel pump arrangements 68 supply a single common rail 46, which provides high pressure fuel to six fuel injectors 40. In this embodiment, in contrast to that of FIG. 5, the fuel pump arrangements 68 are spaced apart, such that the fuel passages 44 that communicate with pump chambers 52 also communicate via injector supply passages 42 to non-adjacent fuel injectors 40.

Figure 7:
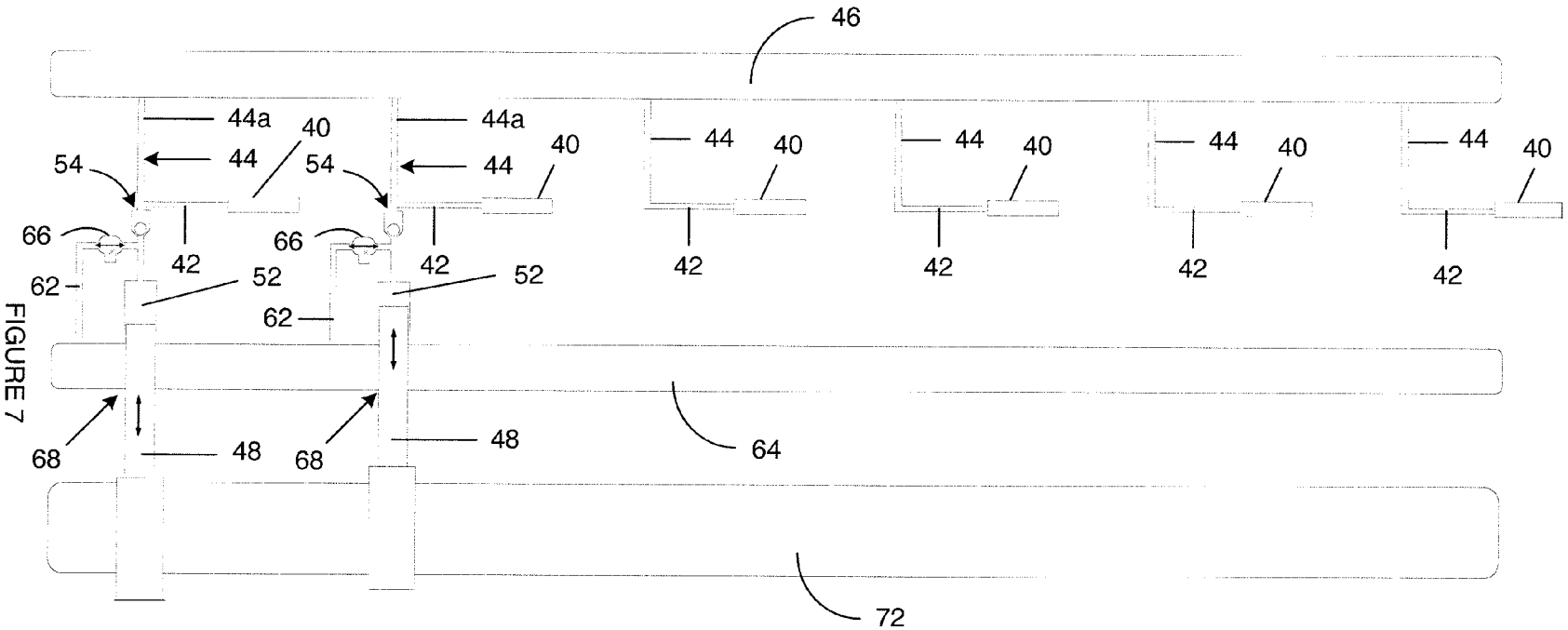
FIG. 7 is a schematic diagram of a fuel injection system according to a fifth embodiment of the invention.

A further embodiment of the fuel injection system of the invention is illustrated in FIG. 7. In this embodiment, two fuel pump arrangements 68 supply pressurised fuel to a single common rail 46, which feeds high pressure fuel for injection to six fuel injectors 40. As in all previous embodiments, a non-return value 54 is located in the two fuel passages 44 that communicate with pump chambers 52, to allow the benefits of the invention to be achieved.

In another mode of operation, the non-return valve 54 may be open during a fuel injection event, such that fuel for that injection event appears to come directly from the fuel pump. However, this circumstance is merely a reflection of the coincidence between the fuel injection event and the pumping stroke of the fuel pump (i.e. at the time of the fuel injection event the fuel pressure in the pumping chamber 52 exceeds that in the common rail 46): it is not a dependent relationship. Advantageously, even in this mode of operation, over a period of use, fuel for injection is principally derived directly from the accumulator volume rather than from the fuel pump. The uninterrupted communication between the fuel injector(s) in the fuel injection system of the invention helps ensure that a substantial flow of fuel, suitable for a main injection event, can be obtained from the accumulator volume, as required.

Accordingly, the fuel injection system of the invention provides the distinct advantage over structurally similar prior art systems, in that the fuel injection cycles/events are independent of the pumping cycle of the fuel pump(s). In more detail engine operation with a fuel injection system of the invention can be considered to involve a number of interrelated "cycles" or processes, for example: (i) the engine camshaft rotation cycle, which in turn causes rotation of one or more cams; (ii) the fuel pump pumping plunger, which is driven through pumping and return strokes by the changing profile of the rotating cam; (iii) the opening and closing of a non-return valve situated between the pump chamber and the accumulator volume (or common rail), which is dependent on the balance of the fuel pressure in the pump chamber and the accumulator volume; and (iv) the operation of the fuel injector to allow a fuel injection event, which is inter alia dependent on the power demand of the engine. The system of the invention further operates to allow the fuel pressure within the accumulator volume to be maintained at a relatively constant, high pressure, which is suitable for injection into the one or more engine cylinders. Accordingly, cycle (iv) above (the fuel injection event), which includes the primary (or main) fuel injection event in circumstances where pre- or post-injections are also used, can occur at any point in time and/or at whichever frequency is required to meet the engine demand. This is a distinct and important advantage in comparison to prior art fuel injection systems, in which the high fuel pressure required for a primary (or main) fuel injection event (as opposed to a pre- or post-injection event) is dependent on the pumping cycle (e.g. the timing of the pumping stroke) of the pumping plunger (step (ii) above), which is in turn dependent on the camshaft cycle (step (i) above).

The independent relationship between fuel injection events and the cycle of the fuel pump in the systems of the invention, therefore, may provide the further advantage that the number of fuel pumps does not need to be equivalent to the number of fuel injectors: i.e. it is not necessary to have a 1:1 relationship between the fuel pumps of the engine and the fuel injectors (and engine cylinders). Advantageously, there may be fewer fuel pumps than fuel injectors (for example, 2 fuel injectors for each 6 fuel injectors and engine cylinders), as described herein. Thus, the production, maintenance/servicing and replacement costs of the fuel injection systems of the invention can be significantly reduced compared to some prior art fuel injection systems. Moreover, the reduction in the production costs of the fuel injection system of the invention (compared to prior art systems) means that the beneficial systems of the invention may be used in smaller and/or cheaper vehicles (e.g. small cars) and still provide the advantages associated with the invention.

It will be appreciated that modifications to the embodiment of the invention depicted in FIG. 5 may be made, without departing from the scope of the invention. In this regard, the fuel injection system may be configured using various combinations of fuel pumps and injectors with one or more distinct accumulator volumes: the important factor being that there is one or more, for example, 2, 3, 4, 5 or 6 fuel injectors for each fuel pump.

Thus, in accordance with another embodiment of the invention there is provided a fuel injection system for an internal combustion engine, the fuel injection system comprising: a first and a second fuel injector 40 which are arranged within (or at least in part defined by) first and second housing units 38, an accumulator volume 46 for supplying fuel to the first and second fuel injectors 40, a first pumping plunger 48 which is driven, in use, to cause pressurisation of fuel within a first pump chamber 52, a first metering valve 66 which is operable to control fuel flow into the pump chamber 52, a first fuel passage 44 providing communication between the first pump chamber 52 and the accumulator volume 46, a first non-return valve 54 located in the first fuel passage 44 between the first pump chamber 52 and the accumulator volume 46, wherein the first fuel injector 40 communicates with the first fuel passage 44 at a position between the first non-return valve 54 and the accumulator volume 46; and a second fuel passage 44 providing communication between the accumulator volume 46 and the second fuel injector 40; and wherein in use the first and second fuel injectors 40 receive fuel from the accumulator volume 46 and not from the first pump chamber 52.

Thus, in some embodiments, the fuel injection system of the invention may comprise between 1 and 12 fuel injectors, for example, 10, 8, 6 or between 1 and 6 fuel injectors; an accumulator volume; and between 1 and 12 fuel pump arrangements, suitably less than 12, for example, 10, 8, 6 or between 1 and 6 fuel pump arrangements. Advantageously, in embodiments where the fuel injection system of the invention comprises a plurality of fuel injectors, there are less fuel pump arrangements than there are fuel injectors. By way of example, fuel injection systems of the invention may suitably comprise: six fuel injectors and five fuel pump arrangements; six fuel injectors and four fuel pump arrangements; six fuel injectors and three fuel pump arrangements; six fuel injectors and two fuel pump arrangements; or six fuel injectors and one fuel pump arrangements. Advantageously, in each case there is provided one accumulator volume, although it is possible that there may be more than one (e.g. 2) accumulator volumes. In each embodiment, the fuel injection system of the invention may further include the additional features of the fuel injection system of the invention as described herein.

It will be appreciated that for each of the plurality of fuel injectors in these embodiments there may be a corresponding housing unit, compatible with known EUI systems. Thus, typically, each of the plurality of fuel injectors is conveniently arranged within (or at least in part defined by) a separate housing unit, such that there is one housing unit for each fuel injector.

Hence, in comparison with common rail systems, the invention provides the benefit that no (or only minor/minimal) changes are required to engines designed for use with EUIs. Furthermore, as already described, where it may be necessary to make such minor adjustments to known engine designs, these changes are beneficial, for example, in that there may be less rockers/rollers required and so on, which may reduce manufacturing cost and increase engine reliability. A hydraulic benefit is also achieved in that the pump chamber of the system is located relatively near to the injector (i.e. the injector is between the common rail 46 and the pump chamber 52).

Figure 1:
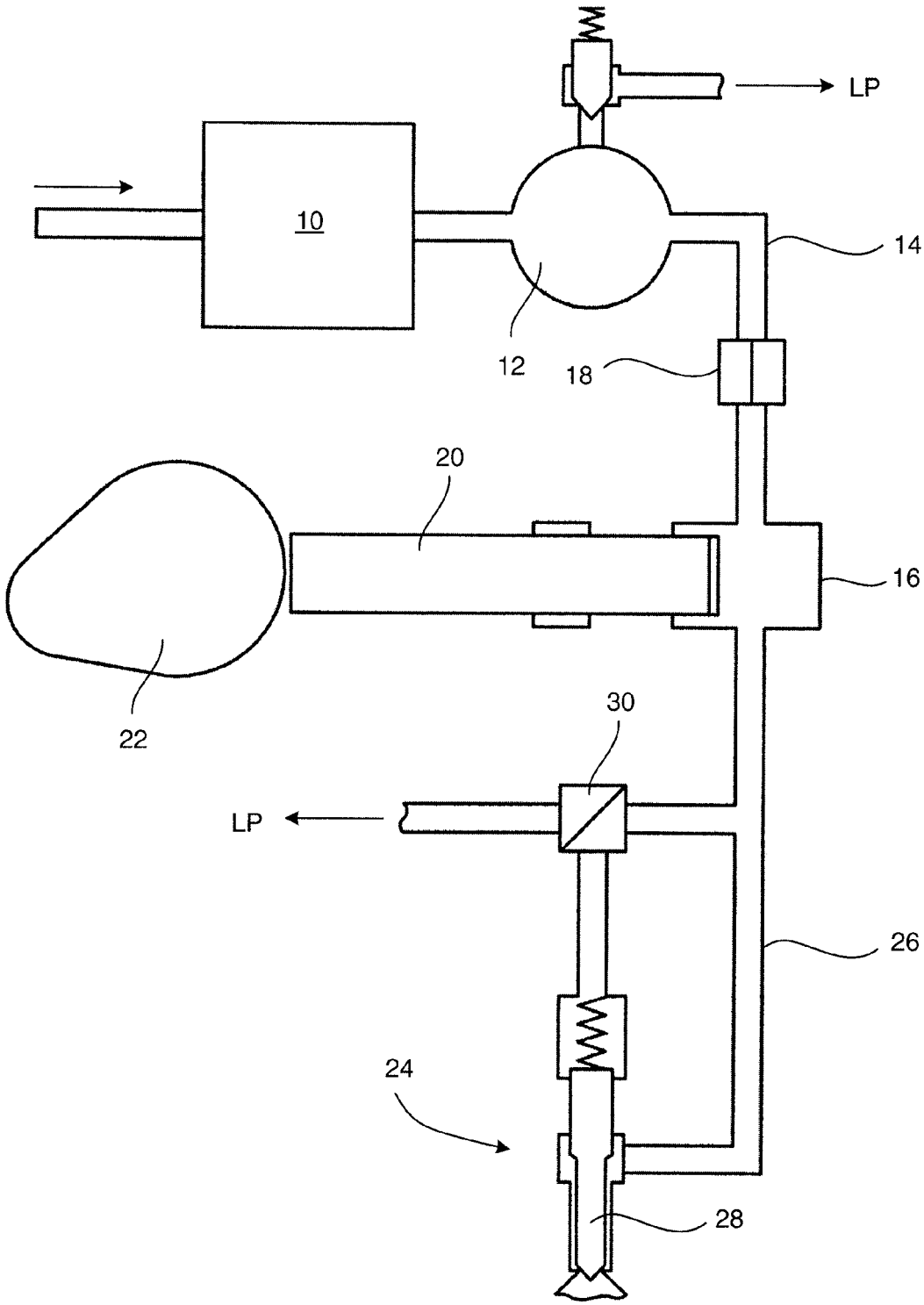
FIG. 1 shows a hybrid system that supplies fuel to a common rail.

The fuel injection systems of the present invention differs from the known hybrid scheme in FIG. 1 in that the common rail 46 in the invention does not supply fuel to the pump chamber 52, but instead only receives fuel from the pump chamber 52 in circumstances in which the non-return valve 54 is open. The non-return valve 54 prevents fuel flowing from the common rail 46 to the pump chamber 52 and, providing a near perfect seal, ensures that the pumping chamber 52 and the metering (or spill) valve 66 are isolated from the common rail 46 for most of the stroke, thereby reducing fuel losses. A further significant difference between the two schemes is that the injector 40 in the system of the invention primarily receives fuel directly from the common rail 46, whereas in FIG. 1 the supply of fuel to the injector from the common rail is via the pump chamber. As previously described, this benefit is manifested in the fact that fuel injection is not dependent on the pumping cycle of the fuel pump.

In order to assemble the fuel injection system into an engine, the EUIs are clamped to the engine cylinder head in a conventional manner and then the common rail is clamped to the engine cylinder head. The necessary pipe connections are then assembled to connect the EUIs with the common rail. In another assembly, the EUIs are clamped into the engine manifold in a conventional manner and then the common rail is clamped directly to the EUIs, without the need for additional pipework. Alternatively the combined common rail-EUI system may be clamped to the engine cylinder head as a single unit.

In any of the embodiments of the invention, whether those described specifically or those envisaged within the scope of the accompanying claims, the injector housing unit 38 for the injector 40 and the pump arrangement 68 may comprise two or more housing parts arranged adjacent to one another, rather than being a single housing part. Whether one or more housing parts are provided to form the injector/pump unit, it is an important feature of the invention that there is no need for a separate fuel pipe or pipes to carry fuel between the injector and pump chamber of the system.

In a further modification to that described previously, the non-return valve 54 need not take the form of a ball but may take an alternative valve form (for example, a plate valve).

Since fuel injection events are independent of the fuel pump, it is possible to pump fuel several times per engine cycle. Therefore, in some embodiments the cam may be a multi-lobe cam so as to provide two or more pumping strokes per engine rotation. Suitably such a multi-lobe cam may comprise 2, 3 or 4 lobes; more suitably 2 or 3 lobes; and most suitably 2 lobes.

A multi-lobe cam may be employed to allow the same or greater fuel pressurisation capability to be achieved by its associated fuel pump but with a smaller plunger diameter. Advantageously, using a multi-lobe cam provides greater pumping capacity per cam revolution, which may also allow a reduction in the number of fuel pumps in a fuel injection system or engine. By way of example, by employing a 2-lobe cam, the pump chamber of a fuel pump may be filled and evacuated (through return and pumping strokes of the pumping plunger, respectively) twice during a single engine (camshaft) rotation. Thus, for instance, the same fuel pressurisation of an associated accumulator volume can be achieved with half as much pumping capacity per pumping stroke and, hence, the diameter of the pumping plunger can be reduced. A number of functional benefits may be achieved by reducing the pumping plunger diameter of a fuel pump. For example, smaller diameter pumping plungers are useful for reducing fuel leakage between the edges of the plunger and the inside of the bore in which the plunger reciprocates and, therefore, for improving engine efficiency. A further advantage is that by significantly reducing the plunger diameter (to less than is practical with traditional EUIs) enables significantly higher injection pressures to be generated in existing engine designs. This may enable an existing engine with, for example, a stress limit of approximately 2500 bar (EUI) to be upgraded to above 4000 bar using the system of the invention, with negligible other modifications (as previously discussed). Smaller diameter pumping plungers may also be beneficial in reducing the fluctuations in cam drive torque required; and it has been recognised, in particular, that a relatively small plunger diameter can be beneficial in reducing stresses (loadings) arising in other engine components, such as the cam and drivetrain.

In addition, it will be appreciated that it can be useful to size the pumping plungers in an engine against the power rating of the engine. Typically, it is advantageous to employ smaller diameter pumping plungers in lower performance engines, for example, so that cost savings can be achieved.

The invention claimed is:

1. A fuel injection system for an internal combustion engine, the fuel injection system comprising:

a first fuel injector which is arranged within a housing unit;

an accumulator volume for supplying fuel to the first fuel injector;

a first fuel pump arrangement comprising a pumping plunger which is driven, in use, to cause pressurisation of fuel within a first pump chamber;

a first metering valve which is operable to control fuel flow into the first pump chamber;

a first fuel passage providing communication between the first pump chamber and the accumulator volume; and a first non-return valve located in the first fuel passage between the first pump chamber and the accumulator volume;

wherein the first fuel injector communicates with the first fuel passage at a position between the first non-return valve and the accumulator volume; and wherein the first fuel passage between the first fuel injector and the accumulator volume does not contain any hydraulic devices that may act to control or prevent the flow of fuel.

2. The fuel injection system as claimed in claim 1, wherein the first fuel injector is an electronically controlled injector.

3. The fuel injection system as claimed in claim 2, wherein the electronically controlled injector includes a three-way control valve for controlling movement of an injector valve needle so as to control fuel injection into the engine.

4. The fuel injection system as claimed in claim 2, wherein the electronically controlled injector includes a two-way control valve for controlling movement of an injector valve needle so as to control fuel injection into the engine.

5. The fuel injection system as claimed in claim 1, wherein in use the first fuel injector receives fuel primarily from the accumulator volume and not from the first pump chamber.

6. The fuel injection system as claimed in claim 1, further comprising a second fuel injector and a second fuel passage; and wherein the second fuel injector communicates with the accumulator volume via the second fuel passage.

7. The fuel injection system as claimed in claim 6, wherein communication between the second fuel injector and the accumulator volume is uninterrupted.

8. The fuel injection system as claimed in claim 6, wherein the second fuel injector is a second electronically controlled injector.

9. The fuel injection system as claimed in claim 6, wherein in use the first fuel injector receives fuel primarily from the accumulator volume and not from the first pump chamber.

10. A fuel injection system as claimed in claim 1, which comprises a plurality of fuel injectors and comprises a fewer number of fuel pump arrangements than fuel injectors.

11. A fuel injection system as claimed in claim 10, which comprises up to six fuel injectors and up to three fuel pump arrangements.

12. A fuel injection system as claimed in claim 10, which comprises six fuel injectors and:

(i) one fuel pump arrangement;

(ii) two fuel pump arrangements; or (iii) three fuel pump arrangements.

13. A fuel injection system for an internal combustion engine, the fuel injection system comprising:

a first fuel injector which is arranged within a housing unit;

an accumulator volume for supplying fuel to the first fuel injector;

a first fuel pump arrangement comprising a pumping plunger which is driven, in use, to cause pressurisation of fuel within a first pump chamber;

a first metering valve which is operable to control fuel flow into the first pump chamber;

a first fuel passage providing communication between the first pump chamber and the accumulator volume; and a first non-return valve located in the first fuel passage between the first pump chamber and the accumulator volume;

wherein the first fuel injector communicates with the first fuel passage at a position between the first non-return valve and the accumulator volume; and wherein fuel supplied to the first fuel injector from the accumulator volume follows a direct path and does not contain any hydraulic devices that may act to control or prevent the flow of fuel.

* * * * *